United States Patent [19]

Takeda et al.

[11] Patent Number: 4,776,015

[45] Date of Patent: Oct. 4, 1988

[54] SPEECH ANALYSIS-SYNTHESIS APPARATUS AND METHOD

[75] Inventors: Shoichi Takeda, Hiki; Akira Ichikawa, Musashino; Yoshiaki Asakawa, Kawasaki, all of Japan

[73] Assignee: Hitachi, Ltd., Tokyo, Japan

[21] Appl. No.: 804,938

[22] Filed: Dec. 5, 1985

[30] Foreign Application Priority Data

Dec. 5, 1984 [JP] Japan ..... 59-255624

[51] Int. Cl.[4] ..... G10L 1/00

[52] U.S. Cl. ..... 381/41; 381/47; 381/49; 364/513.5

[58] Field of Search ..... 381/36, 37, 38, 39, 381/41, 46, 47, 49, 50, 51; 364/513.5

[56] References Cited

U.S. PATENT DOCUMENTS

| | | | |
|---|---|---|---|
| 4,081,605 | 3/1978 | Kitawaki et al. | 381/49 |
| 4,282,405 | 8/1981 | Taguchi | 381/49 X |
| 4,282,406 | 8/1981 | Yato et al. | 381/49 |
| 4,672,670 | 6/1987 | Wang et al. | 381/36 X |

*Primary Examiner*—Peter S. Wong

*Attorney, Agent, or Firm*—Antonelli, Terry & Wands.

[57] ABSTRACT

Herein disclosed is a speech analysis-synthesis apparatus which resorts to a multi-pulse exciting method using a plurality of modeled pulses as a synthetic sound source if input speech is analyzed so that speech may be synthesized on the basis of the analyzed result. A factor for effecting perpetual weighting in a manner to correspond to the sound source pulse number is made variable, and the error between the input speech and the synthesized speech is perceptually weighted so that the amplitude and location of the train of the sound source pulses are so determined as to minimize said error.

17 Claims, 6 Drawing Sheets

ENCODER $Q_1$: LPC COEFFICENT QUANTIZATION/ENCODING
$Q_2$: SOUND SOURCE PULSE QUANTIZATION/ENCODING
DECODER $Q_1^{-1}$: LPC COEFFICENT DECODER
$Q_2^{-1}$: SOUND SOURCE PULSE DECODER

ENCODER $Q_1$: LPC PITCH QUANTIZATION
$Q_2$: SOUND SOURCE PULSE QUANTIZATION
DECODER $Q_1^{-1}$ LPC PITCH QUANTIZATION
$Q_2^{-1}$ SOUND SOURCE PULSE QUANTIZATION

| M | γ |
|---|---|
| 0 | 1.0 |
| 1 | 0.98 |
| 2 | 0.97 |
| ⋮ | ⋮ |
| 16 | 0.8 |
| ⋮ | ⋮ |
| 80 | 0.0 |

SPEECH ANALYSIS-SYNTHESIS APPARATUS AND METHOD

BACKGROUND OF THE INVENTION

The present invention relates to improvements in a speech analysis-synthesis apparatus.

The method, by which speech is separated into spectral envelope information mainly for bearing information such as "a" or "i" in Japanese, and source information carrying an accent or intonation so that it may be processed or transmitted, is called the "source coding method". This is exemplified by the PARCOR (i.e., Partial Auto-Correlation) coding method or the LSP (i.e., Line Spectrum Pair) coding method.

The source coding method can compress speech information so that it finds suitable application to voice mail, toys and educational devices. The aforementioned information separability of the source coding method is indispensable for characters for the speech synthesis-by-rule. In the source coding method of the prior art, as shown in FIG. 1(*a*), either model white noise 1 or an impulse train 2 is switched for use as the source information. At this time, the source information applied to a synthesizer is therefore (1) voiced/unvoiced information 3, (2) information amplitude 4, and (3) a pitch period (or pitch or fundamental frequency) 5.

By using the above-specified information (1), more specifically, the impulse train is generated in the voiced case, whereas the white noise is generated in the unvoiced case. The amplitudes of those signals are given by the aforementioned amplitude (2). Moreover, the interval of generating the impulse train is given by the aforementioned pitch period (3).

By making use of such model sound sources, the following speech quality degradations result so that the analysis-synthesis speech according to the source coding method of the prior art has failed to clear a predetermined limit in the quality:

(1) Speech quality degradation due to the misjudgement of the voiced/unvoiced information in the analysis;

(2) Speech quality degradation due to an erroneous pitch extraction or detection;

(3) Speech quality degradation based upon the incompleteness of separation between the formant component and pitch component in the speech "i" or "u";

(4) Speech quality degradation caused by the limit of the AR-model (i.e., Auto-Regressive) of the PARCOR coding method because the zero or anti-pole information of the spectrum cannot be carried; and (5) Speech quality degradation caused because the non-stationary component or the fluctuating information important for naturalness of the speech is lost.

One means for eliminating those causes for the speech quality degradations is the "Multi-Pulse Exciting Method (which will hereafter be referred to as the MPE method)", by which a plurality of pulses generated for a one-pitch period or for a period corresponding to the former in the unvoiced case are used as the sound source in place of the "single-impulse/white noise" of the prior art.

Methods relating to that exciting method of the above-specified kind are enumerated, as follows:

(1) B. S. Atal and J. R. Remde: A New Model of LPC Excitation for Producing Natural-Sounding Speech at Low Bit Rates, Proc. ICASSP82, pp614–617 (1982);

(2) Ozawa, Arazeki and Ono: Examinations of Speech Coding Method of Multi-Pulse Exciting Type, Reports of Communication Association, CS82-161, pp115–122 (1983-3); and (3) Ozawa, Ono and Arazeki: Improvements in Quality of Speech Coding Method of Multi-Pulse Exciting Type, Materials of Speech Research Party of Japanese Audio Association, S83-78 (1984-1).

Such multi-pulse method is schematically shown in FIG. 1(*b*). According to this exciting method, it is true that the quality of synthesized speech is improved, but a problem remains in that the quality is so saturated that it cannot be improved beyond a certain quality even if the quantity of speech information (e.g., the number of pulses) is increased.

SUMMARY OF THE INVENTION

An object of the present invention is to provide a method for improving the characteristics of the multi-pulse method while preventing the quality from reaching the saturation point in accordance with the increase in the number of the source pulses.

In order to achieve this object, according to the present invention, there is provided a speech analysis-synthesis apparatus resorting to the multi-pulse exciting method, in which a weighting factor for controlling the audio-weighting applied to minimize the error between input speech and synthesized speech obtained by analyzing and synthesizing the input speech is made variable in accordance with the number of sound source pulses.

BRIEF DESCRIPTION OF THE DRAWINGS

FIG. 1(*b*) is a block diagram showing the analysis-synthesis apparatus using the multi-pulse exciting method of the prior art;

FIG. 6(*b*) is a diagram showing the correspondence between a weighting factor and a number M of sound source pulses;

FIG. 8(*b*) is a diagram showing a structure for determining the weighting factor.

DESCRIPTION OF THE PREFERRED EMBODIMENTS

Figure 1A:
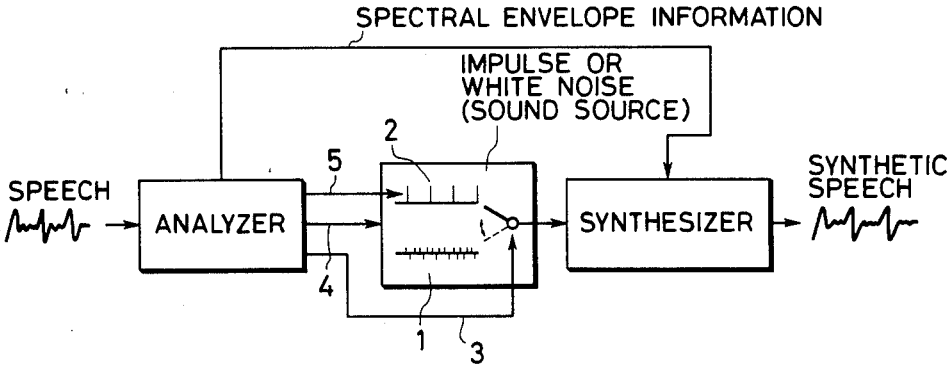
FIG. 1(*a*) is a block diagram showing the analysis-synthesis apparatus of the prior art.
Figure 1B:
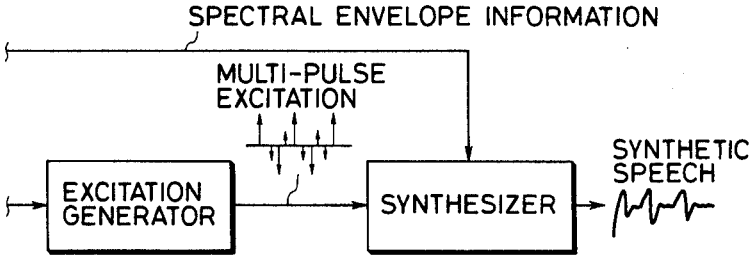
Figure 2:
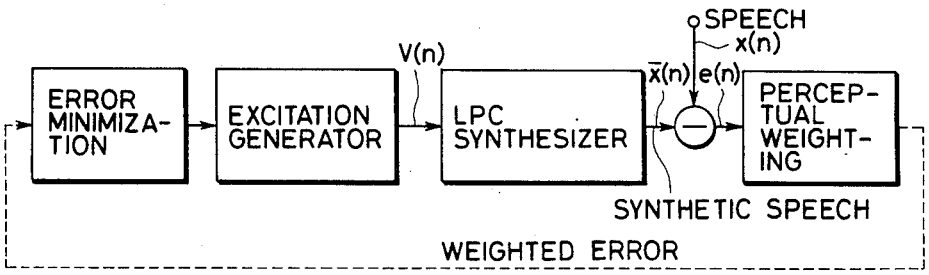
FIGS. 2, 3(*a*), 3(*b*) and 4 to 5 are diagrams showing the principle of the present invention.

The principle of the present invention will be described in the following detailed description related to the embodiments. First of all, the principle of the multi-pulse method will be explained by quoting the above-specified examples (1) to (3) of the prior art. FIG. 2 shows the pulse determining processing. The coefficient of an LPC (i.e. Linear Predictive Coefficient) synthesis filter is calculated for each frame from an input speech x(n). In this method, a synthetic filter is excited by a sound source pulse train to synthesize a signal $\bar{x}(n)$, and an error e(n) between the input speech and the synthesized speech is determined to make a perceptual weighting. Here, the weighting function can be expressed by the following Equation by using a Z-transform:

$$W(z) = \frac{1 - \sum_{k=1}^{P} a_k z^{-k}}{1 - \sum_{k=1}^{P} a_k \gamma^k z^{-k}}. \quad (1)$$

Here: $a_k$ designates the filter factor of the linear predictive coefficient (i.e., LPC) filter; P designates a filter order; and $\gamma$ is a factor (i.e., a weighting factor) indicating the degree of the weighted effect and is selected to be $0 \leqq \gamma \leqq 1$. The weighting filter is characterized so as to suppress the spectral formant peak such that it has a greater suppressing effect as the value of $\gamma$ approaches 0 and a lesser suppressing effect as the value of $\gamma$ approaches 1. Next, a squared error is determined from the weighted error so that the amplitude and location of the pulses are so determined as to minimize that squared error. This processing is repeated to sequentially determine the pulses. If this method is executed as it is, a vacant number of calculations are required because the analysis-synthesis processing is involved in the pulse locating loop. As a matter of fact, therefore, the following efficient method is used, in which the error is calculated by using the impulse response of the synthesizing filter rather than synthesizing processing for each pulse location:

If the squared error is designated at $\epsilon$, then it is expressed by the following Equation:

$$\epsilon = \sum_{n=1}^{N} [\{x(n) - \bar{x}(n)\} * w(n)]^2. \quad (2)$$

Here, the symbol "*" designates the convolution. N designates the number of samples of a section in which the errors are calculated; x(n) and $\bar{x}(n)$ designate the original speech signal and the synthesized speech signal; and w(n) designates the impulse response of the noise-weighting filter of the Equation (1). When the errors are defined by Equation (2), the minimum of the errors, and the location and amplitude of the sound source pulses giving the former are determined by the following procedure. The following procedures correspond to that of a single frame and may be repeatedly executed with respect to each frame for a long speech data stream.

If an ith pulse has its location from the frame end designated by $m_i$ and its coded amplitude designated by $g_i$, the exciting sound source signal $v_n$ of the synthesizing filter can be expressed for a time n by the following Equation (3):

$$v_n = \sum_{i=1}^{M} g_i \cdot \delta_{n,m_i}. \quad (3)$$

Here, $\delta_{n,m}$ designates Kronecker's delta, and $\delta_{n,m_i}=1$ (for $n=m_i$) and $\delta_{n,m_i}=0$ (for $n \neq m_i$). M designates the number of the sound source pulses. Now, if the transfer characteristic of the synthesizing filter is expressed in terms of an impulse response h(n) ($0 \leqq n \leqq N-1$), the synthesized speech signal x(n) is expressed, as follows:

$$x(n) = \sum_{l=0}^{N-1} v_n h(n - l). \quad (4)$$

If Equation (3) is substituted into Equation (4) and is rearranged, the synthesized speech signal is expressed by the following Equation:

$$\bar{x}(n) = \sum_{i=1}^{M} g_i h(n - m_i). \quad (4')$$

Alternatively, the following Equation is deduced as the weighted synthesized speech signal:

$$\bar{x}_w(n) = \left\{ \sum_{i=1}^{M} g_i h(n - m_i) \right\} * w(n). \quad (4'')$$

If Equation (4') is substituted into Equation (2), the error is expressed by the following Equation:

$$\epsilon = \sum_{n=1}^{N} \left[ \left\{ x(n) - \sum_{i=1}^{M} g_i h(n - m_i) \right\} * w(n) \right]^2. \quad (2')$$

The above-specified Equations (4'), (4'') and (2') imply that the synthesized speech signal value and the error value can be attained without any real waveform synthesization if the impulse response of the synthesizing filter of said frame is determined at first.

The amplitude and location of the pulse minimizing the Equation (2') are given at a point where the following Equation obtained by partially differentiating the Equation (2') for $g_i$ and by setting it at 0:

$$g_N = \begin{cases} \max\limits_{1 \leqq m \leqq N} \left| \dfrac{\phi_{hn}(m)}{R_{hh}(0)} \right| (M = 1) \\ \max\limits_{1 \leqq m \leqq N} \left| \dfrac{\phi_{hn}(m) - \sum_{l=1}^{N-1} g_l R_{hh}|m_l - m|}{R_{hh}(0)} \right| \\ (M = 2, 3 \ldots) \end{cases}. \quad (5)$$

Here, $R_{hh}$ designates the auto-correlation function of $h_w(n)$ ($\triangleq h(n)*w(n)$), and $\phi_{hn}$ designates the cross-correlation function between $h_w(n)$ and $x_w(n)$ ($\triangleq x(n)*w(n)$). The maximum of the Equation (5) and the point giving that maximum can be determined by the well-known maximum locating method.

Figure 3A:
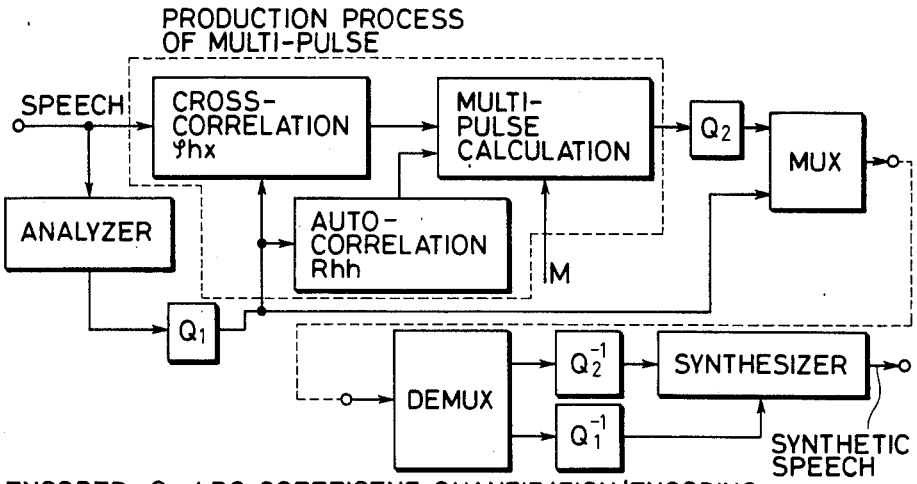
Figure 3B:
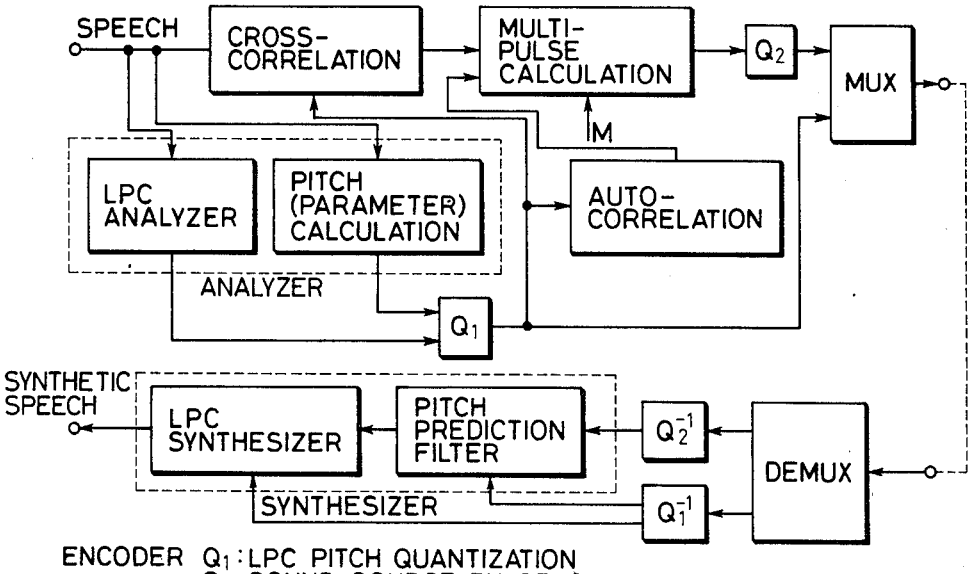

The speech analysis-synthesis method (or the speech coding method) constructed on the basis of the principle thus far described is schematically shown in FIG. 3(*a*).

The present invention relates to the apparatus for giving the optimum weighting factor $\gamma$ in a manner to correspond to the given number M of the pulses to be added in the speech analysis-synthesis method of FIG. 3(*a*), for example. It is evident that this method to be described hereinafter is such a general one as can be applied to a variety of modifications including the speech analysis-synthesis method of FIG. 3(*b*), as is disclosed in the citation (3) of the prior art. Despite this fact, however, the method of FIG. 3(*a*) will be described hereinafter by way of example. A similar concept may be applied to the other methods.

Figure 4:
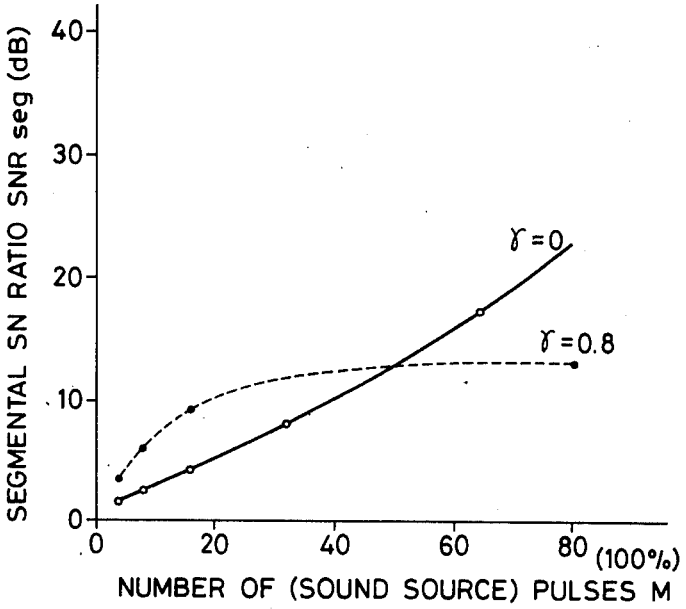

FIG. 4 shows the quality of the synthesized speech when the sound source pulses are generated and synthesized by the multi-pulse method. Here, the "segmental S/N ratio $SNR_{seg}$ of the voiced part" expressing the quality is a measure indicating how much waveform distortion is contained by the synthesized speech for the voiced part with respect to the original speech, and is defined by the following Equation:

$$SNR_{seg} = \frac{1}{N_F} \sum_{F=1}^{N_F} SNR_F. \quad (6)$$

Here, $N_F$ designates the frame number (of the voiced part) in a section measured, and $SNR_F$ designates an Fth frame SNR, which is expressed by the following Equation:

$$SNR = 10\log_{10} \frac{\sum_{n=1}^{N} \{x(n)\}^2}{\sum_{n=1}^{N} \{x(n) - \bar{x}(n)\}^2}. \quad (7)$$

As is seen from FIG. 4, when the weighting effect is relatively low ($\gamma=0.8$), the quality is at saturation so as to fail to improve if the sound source pulse number M is increased to a predetermined number or more. If the weighting effect is increased ($\gamma=0$); however, the greater the number of the sound source pulses, the more the quality is improved. Despite this fact, the quality of the small sound source pulse number is degraded, as compared with the case of the lower weighting effect.

Figure 5:
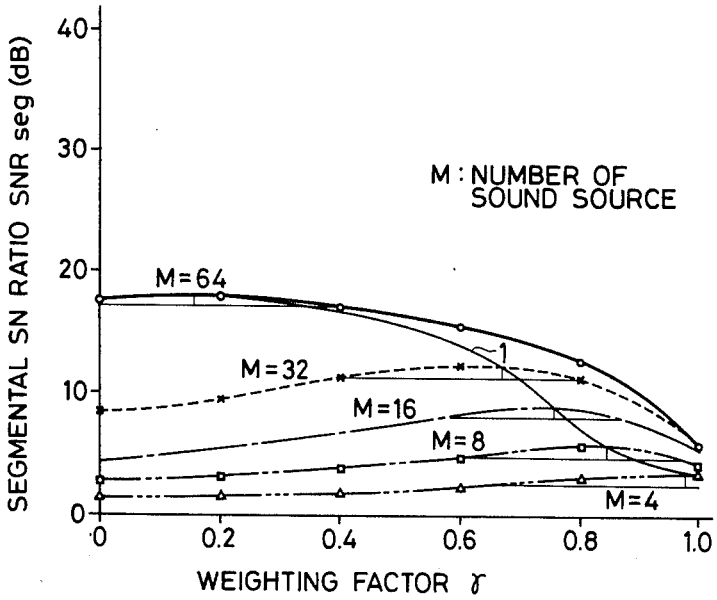

As is clear from the discussion above, if a large value of $\gamma$ is selected for the smaller sound source pulse number whereas a small value of $\gamma$ is selected for the larger sound source pulse number, the highest quality can be attained in dependence upon the sound source pulse number. From FIG. 5 plotting the changes of the quality ($SNR_{seg}$) for the value of the weighting factor when sound source pulse number M is set at various values, it is found that the maximum of the quality changes with the change in the value of the pulse number M. The curve appearing in FIG. 5 indicates the maximum quality curve which joins those plotted maximums.

The present invention is based upon the principle that the weighting factor $\gamma$ on the curve 1 is given in a manner to correspond to the sound source pulse number M given.

The apparatus based upon the aforementioned principle can be used as not only the analysis apparatus for obtaining a sound source for the speech synthesis of high quality but also solely as a sound synthesis apparatus of high quality using that sound source. The apparatus based on the principle can naturally be further used as an analysis-synthesis apparatus in which the aforementioned analysis apparatus and synthesis apparatus are integrated.

The embodiments of the present invention will be described in the following.

Figures 6A, 6B:
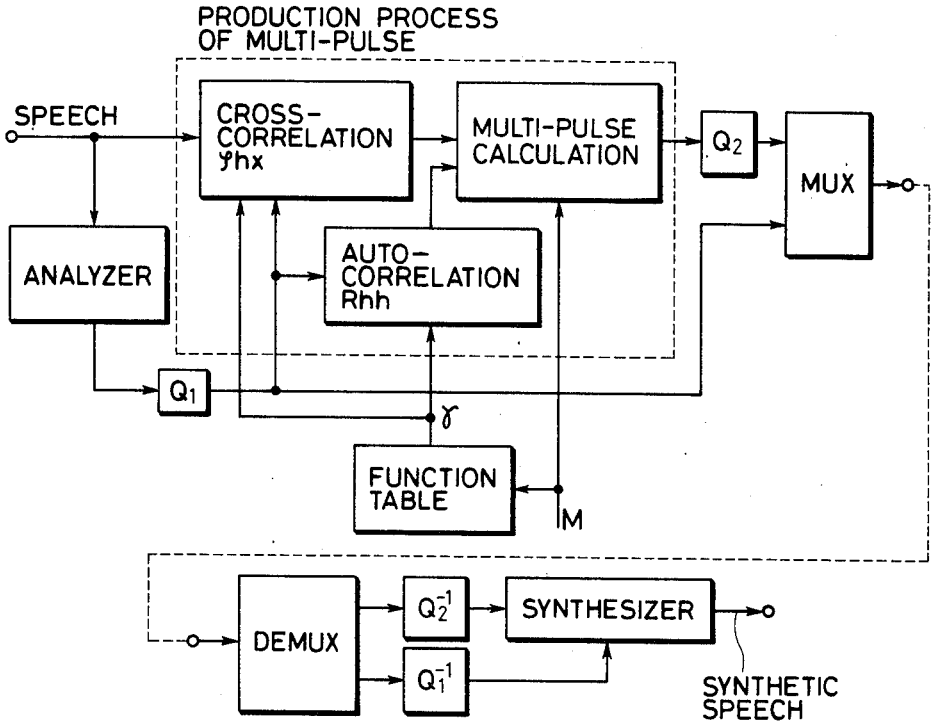
FIG. 6(*a*) is a block diagram showing a first embodiment of the present invention.
Figure 7:
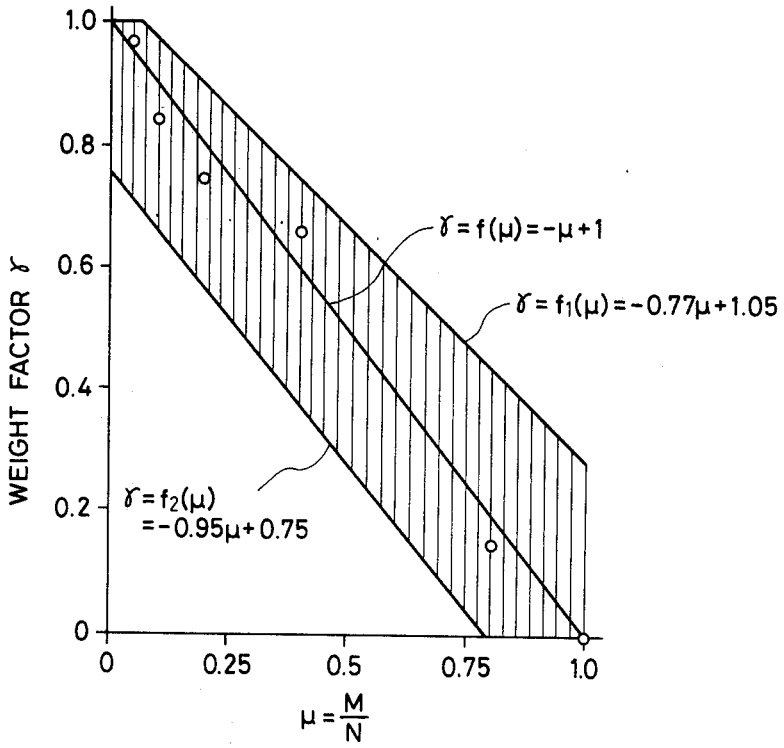
FIG. 7 is a diagram showing a region which can be taken by the weighting factor $\gamma$ for the content of the sound source pulses.
Figure 8A:
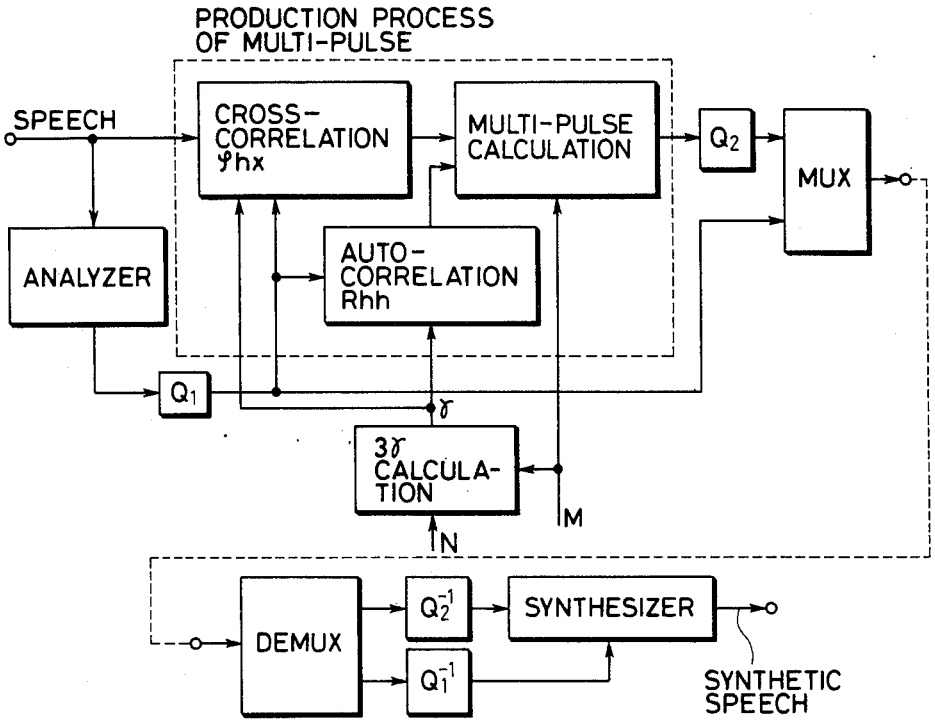
FIG. 8(*a*) is a block diagram showing a second embodiment of the present invention.
Figure 8B:
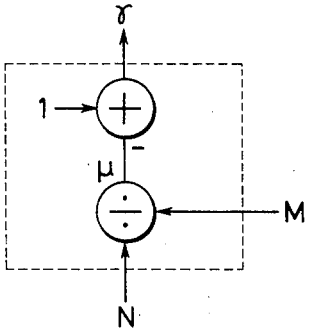

FIG. 6 shows the overall system for speech analysis and synthesis according to a first embodiment of the present invention. It is assumed that the sound source pulse number M be either set at a constant value or given by another well-known means. The sound source number M is input to a function table 2 so that the value of the weighting factor $\gamma$ corresponding the value M is output in the form of a function $\gamma=f(M)$ from the function table 2. After this value $\gamma$ has been fed to the weighting filter given by the Equation (1), the auto-correlation $R_{hh}$ and the cross-correlation $\phi_{hx}$ are calculated so that the sound source pulses are determined by the well-known means using the Equations (2) to (5) described hereinbefore. Here, the function appearing in the function table 2 is given, for example, by an approximate straight line $\gamma=f(\mu)$ ($\mu=M/N$) joining the circles of FIG. 7, which are plotted to correspond to the peak values on the curve 1 of FIG. 5. In the function table 2, on the other hand, the value $\gamma$ is given for the sound source pulse number M, as shown in FIG. 6(*b*). The function table presented here exemplifies the case in which the maximum number of sound source pulses in one frame is 80. If the maximum number of sound source pulses differ with the difference of the analyzing condition, too, the value $\gamma$ can be realized even under any analyzing condition by preparing a similar table in a manner to correspond to the analyzing condition. In place of using the function table, alternatively, the value may be calculated directly from the values M and N by the $\gamma$-calculating means 3, as shown in FIG. 8(*a*). In case $\gamma=f(\mu)=-\mu+1$, for example the $\gamma$-calculating means can be easily constructed of a divider for calculating the value M/N and a subtractor for calculating the value $(1-\mu)$, as shown in FIG. 8(*b*).

The embodiment thus far described is especially effective if the sound source pulse number changes from one moment to the next, frame by frame.

Next, a second embodiment of the present invention will be described in the following.

The foregoing first embodiment is directed to the method of uniquely giving the value $\gamma$ for the value of the sound source pulse number M (while assuming the value N be fixed). Despite this fact, however, the value $\gamma$ can be allowed to have some range under the condition that the quality of the synthesized speech is maintained at a level over a predetermined allowable limit. This concept of setting the value $\gamma$ is practised in the second embodiment. The length of the vertical segment drawn from the quality peak point in each sound source pulse number of FIG. 5 indicates the segmental S/N ratio of 1 (dB), whereas the horizontal segment drawn from the lowermost point of said vertical segment indicates the range which can be taken by the value $\gamma$ in case the quality degradation of 1 (dB) at the highest from the highest quality in each sound source pulse number is allowed. This allowable range is shown by the hatched area in FIG. 7 and bounded by approximate straight lines (which are all included). An arbitrary $\gamma$ value located in the above-specified zone may be selected for the given sound source pulse number (and the maximum sound source pulse number N).

This sound embodiment is effective especially if the sound source pulse number has to be constant. In this case, if fixed values for $\gamma$ are determined for the predetermined M (and N) values, both the function table 2 of FIG. 6 and the $\gamma$-calculating means of FIG. 8 can be dispensed with.

From the discussion thus far made, the first embodiment is suitable for synthesis-by-rule and synthesis of the storage type because the sound source pulse number can be made variable, whereas the second embodiment is suitable for compression transmission having a limited channel capacity because the sound source pulse number is constant. The value $\gamma$ to be used in the first embodiment may naturally be selected from the range of the value $\gamma$ of the second embodiment.

As has been described hereinbefore, according to the present invention, synthesized speech of the highest quality can be generated for an arbitrary sound source pulse number. The present invention is effective for both the case, in which the sound source pulse number M is given as a constant value, and the case in which the number M is given as a variable value suited for the speech data.

What is claimed is:

1. A speech analysis apparatus comprising:
means to input speech;
analyzing means for analyzing the speech input to obtain spectral envelope information;
means for determining an impulse response from said spectral envelope information;
means for determining a factor for effecting perceptual weighting in a manner to correspond to a sound source pulse number;
means for determining a cross-correlation between the input speech and said impulse response, wherein both are perceptually weighted on the basis of said factor;
means for determining an auto-correlation from the impulse response which is perceptually weighted on the basis of said factor; and
means for generating sound source information necessary for the speech analysis from said cross-correlation, said auto-correlation and said sound source pulse number.

2. A speech analysis apparatus according to claim 1, wherein said sound source information generating means determines amplitude and location of sound source pulses.

3. A speech analysis apparatus according to claim 2, further including means for synthesizing speech corresponding to said input speech, and wherein said amplitude and location of said sound source pulses are determined so that the error between the input speech and said synthesized speech generated by said means for synthesizing may be minimized.

4. A speech analysis apparatus according to claim 1, wherein said factor of said factor determining means is selected to have a value $\gamma$ satisfying the following conditions:

$$0 \leqq \gamma \leqq 1;$$

$$\gamma \leqq -0.77M/N+1.05; \text{ and}$$

$$\gamma \leqq -0.95M/N+0.75;$$

wherein M is an integer corresponding to the number of said sound source pulses and N is an integer corresponding to the maximum number of said sound source pulses within one frame.

5. A speech analysis apparatus according to claim 1, wherein said sound source pulses generated are used as a sound source.

6. A speech apparatus according to claim 1, wherein said source pulses generated are used as a sound source in speech synthesizing.

7. A speech analysis-synthesis method by a multipulse excitation using a plurality of pulses generated in a modelled manner as a synthetic sound source if an input is to be analyzed so that speech may be synthesized on the basis of the analyzed result, comprising the steps of:
providing a variable factor for effecting in a perceptually weighting factor in a manner to correspond to a sound source pulse number;
perceptually weighting said input speech and an impulse response which is determined from spectral envelope information obtained as a result of the analysis of said input speech;
determining a cross-correlation between said input speech and said impulse response, wherein both of which are perceptually weighted;
determining an auto-correlation from said impulse response which is perceptually weighted; and
generating an amplitude and location of said sound source pulses from said cross-correlation and said auto-correlation.

8. A speech analysis apparatus for generating a sound source to be used in speech synthesizing, comprising:
means to input speech;
analyzing means for analyzing inputted speech to obtain spectral envelope information;
means for determining an impulse response from said spectral envelope information;
means for determining a factor for effecting perceptual weighting in a manner to correspond to a sound source pulse number;
means for determining a cross-correlation between the input speech and said impulse response, wherein both are perceptually weighted on the basis of said factor;
means for determining an auto-correlation from the impulse response which is perceptually weighted on the basis of said factor; and
means for generating sound source information necessary for the speech analysis in response to said cross-correlation and said auto-correlation.

9. A speech analysis apparatus used in speech synthesizing according to claim 8, wherein said sound source information generating means determines amplitude and location of sound source pulses.

10. A speech analysis apparatus used in speech synthesizing according to claim 9, further including means for synthesizing speech corresponding to said inputted speech, and wherein said amplitude and location of said sound source pulses are determined so that the error between the inputted speech and said synthesized speech generated by said means for synthesizing may be minimized.

11. A speech analysis apparatus according to claim 8, wherein said factor of said determining means is selected to have a value $\gamma$ satisfying the following conditions:

$$0 \leqq \gamma \leqq 1;$$

$$\gamma \leqq -0.77M/N+1.5; \text{ and}$$

$$\gamma \leqq -0.95M/N+0.75;$$

wherein M is an integer corresponding to the number of said sound source pulses and N is an integer corresponding to the maximum number of said sound source pulses within one frame.

12. A speech analysis apparatus comprising:
means to input speech;
analyzing means for analyzing inputted speech to obtain spectral envelope information;
means for determining an impulse response from said spectral envelope information;
means for determining a factor for effecting perceptual weighting in a manner to correspond to a sound source pulse number;
means for determining a cross-correlation between the input speech and said impulse response, wherein both are perceptually weighted on the basis of said factor;

means for determining an auto-correlation from the impulse response which is perceptually weighted on the basis of said factor; and means for generating sound source information necessary for the speech analysis in response to said cross-correlation and said auto-correlation.

13. A speech analysis apparatus according to claim 12, wherein said sound source information generating means determines amplitude and location of sound source.

14. A speech analysis apparatus according to claim 13, further including means for synthesizing speech corresponding to said inputted speech, and wherein said amplitude and location of said sound source pulses are determined so that the error between the inputted speech and said synthesized speech generated by said means for synthesizing may be minimized.

15. A speech analysis apparatus according to claim 12, wherein said factor of said factor determining means is selected to have a value $\gamma$ satisfying the following conditions:

$$0 \leqq \gamma \leqq 1;$$

$$\gamma \leqq -0.77M/N + 1.05; \text{ and}$$

$$\gamma \leqq -0.95M/N + 0.75;$$

wherein M is an integer corresponding to the number of said sound source pulses and N is an integer corresponding to the maximum number of said sound source pulse within one frame.

16. A speech analysis apparatus according to claim 12, wherein said sound source pulses generated are used as a sound source.

17. A speech apparatus according to claim 12, wherein said source pulses generated are used as a sound source in speech synthesizing.

* * * * *